US012487049B2

(12) United States Patent
Chang

(10) Patent No.: US 12,487,049 B2
(45) Date of Patent: Dec. 2, 2025

(54) STRING-UNLOADING APPARATUS OF A CROSSBOW

(71) Applicant: COMBIS SPORT ENTERPRISE CO., LTD., Taichung (TW)

(72) Inventor: Chu-Wei Chang, Taichung (TW)

(73) Assignee: COMBIS SPORT ENTERPRISE CO., LTD., Taichung (TW)

( * ) Notice: Subject to any disclaimer, the term of this patent is extended or adjusted under 35 U.S.C. 154(b) by 176 days.

(21) Appl. No.: 18/427,318

(22) Filed: Jan. 30, 2024

(65) Prior Publication Data

US 2025/0244100 A1 Jul. 31, 2025

(51) Int. Cl.
*F41B 5/12* (2006.01)
*F41B 5/14* (2006.01)

(52) U.S. Cl.
CPC ..... *F41B 5/1469* (2013.01); *F41B 5/12* (2013.01)

(58) Field of Classification Search
CPC ..... F41B 5/12; F41B 5/1469
See application file for complete search history.

(56) References Cited

U.S. PATENT DOCUMENTS

| | | | | |
|---|---|---|---|---|
| 6,736,123 | B1 * | 5/2004 | Summers | F41B 5/1469 124/40 |
| 9,360,268 | B2 | 6/2016 | Khoshnood | |
| 9,435,605 | B2 * | 9/2016 | McPherson | F41B 5/12 |
| 10,401,117 | B1 * | 9/2019 | Rowzie, Jr. | F41A 19/06 |
| 10,508,884 | B1 * | 12/2019 | Chen | F41A 17/46 |
| 11,002,505 | B1 | 5/2021 | Shaffer et al. | |
| 11,592,258 | B2 * | 2/2023 | Shaffer | F41B 5/123 |
| 11,808,545 | B1 * | 11/2023 | Chu | F41B 5/1469 |
| 11,885,587 | B2 * | 1/2024 | Shaffer | F41B 5/1469 |

FOREIGN PATENT DOCUMENTS

| | | |
|---|---|---|
| TW | 207344 U | 6/1993 |
| TW | I662245 B | 6/2019 |

* cited by examiner

*Primary Examiner* — John A Ricci
(74) *Attorney, Agent, or Firm* — MUNCY, GEISSLER, 1OLDS & LOWE, P.C.

(57) ABSTRACT

A crossbow includes a string, a trigger assembly, a safety and a string-unlocking apparatus. Only one hand is required to use a cocking device to operate the string-unlocking apparatus to move the safety to an unlocking position from a locking position and to pivot the trigger assembly to a releasing position from a hooking position.

8 Claims, 17 Drawing Sheets

STRING-UNLOADING APPARATUS OF A CROSSBOW

BACKGROUND OF INVENTION

1. Field of Invention

The present invention relates to a crossbow and, more particularly, to a string-unloading apparatus of a crossbow.

2. Related Prior Art

As disclosed in Taiwanese Patent No. 207344, a crossbow includes a barrel, two limbs transversely connected to a front section of the barrel, a string tied to the limbs, and a trigger pivotally connected to a rear section of the barrel. The string is loaded and held by the trigger before an arrow is loaded on the barrel. Then, the trigger is operable to release the string to shoot the arrow. Details of such a trigger can be seen in Taiwanese Patent I662245 for example.

However, sometimes, there is no proper target or environment for shooting after the arrow and the string are loaded. Hence, the arrow and the string have to be unloaded.

To this end, the trigger is operable to release the string to shoot the arrow at a soft object. However, this inevitably damages the arrow.

Alternatively, the trigger is operable to release the string after the arrow is unloaded. However, this inevitably damages the crossbow.

Alternatively, an archer uses one hand to operate the trigger and uses the other hand to operate a cocking device to pull the string so that the archer slowly and gently unloads the string. However, this practice is inconvenient for the archer for he or she has to use both hands.

To solve the above-mentioned problems, devices have been devised such as in U.S. Pat. Nos. 11,002,505 and 9,360,268B2. However, the structures of these devices are complicated and the operations of these devices are inconvenient.

The present invention is therefore intended to obviate or at least alleviate the problems encountered in the prior art.

SUMMARY OF INVENTION

It is the primary objective of the present invention to provide a simple and convenient string-unloading apparatus for a crossbow.

To achieve the foregoing objective, the string-unloading apparatus includes a box, a trigger assembly, a switch, a lever, a pulling element, an oar, a torque spring, a restraining element and a compression spring. The box is connected to a crossbow. The trigger assembly is connected to the box and operable to control a string. The switch is movable in the box between a safety position, a preparatory position and a string-unloading position. The switch includes a handle extending from the box, a first slope and an abutment portion formed on a front face, a dent made in an upper face, a cutout made in a lower face, and a second slope formed on a rear face. The lever includes an upper end inserted in the cutout, a middle section pivotally connected to the box, and a lower end. The pulling element includes a rear end pivotally connected to the lower end of the lever, a front end pivotally connected to the box, and a tab for contact with the trigger assembly. The oar is movable vertically and horizontally in the box. The oar includes a bar and a plate formed at an upper end of the bar. The plate includes a lower face in contact with the first slop. The hook is formed at a lower end of the bar and operable for moving the trigger assembly to release the string. The torque spring is pivotally connected to the box. The torque spring includes an end movable between the dent and the second slope. The restraining element is pivotable between a first position for blocking the abutment portion and a second position away from the abutment portion. The compression spring is operable for biasing the tab toward the trigger assembly.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
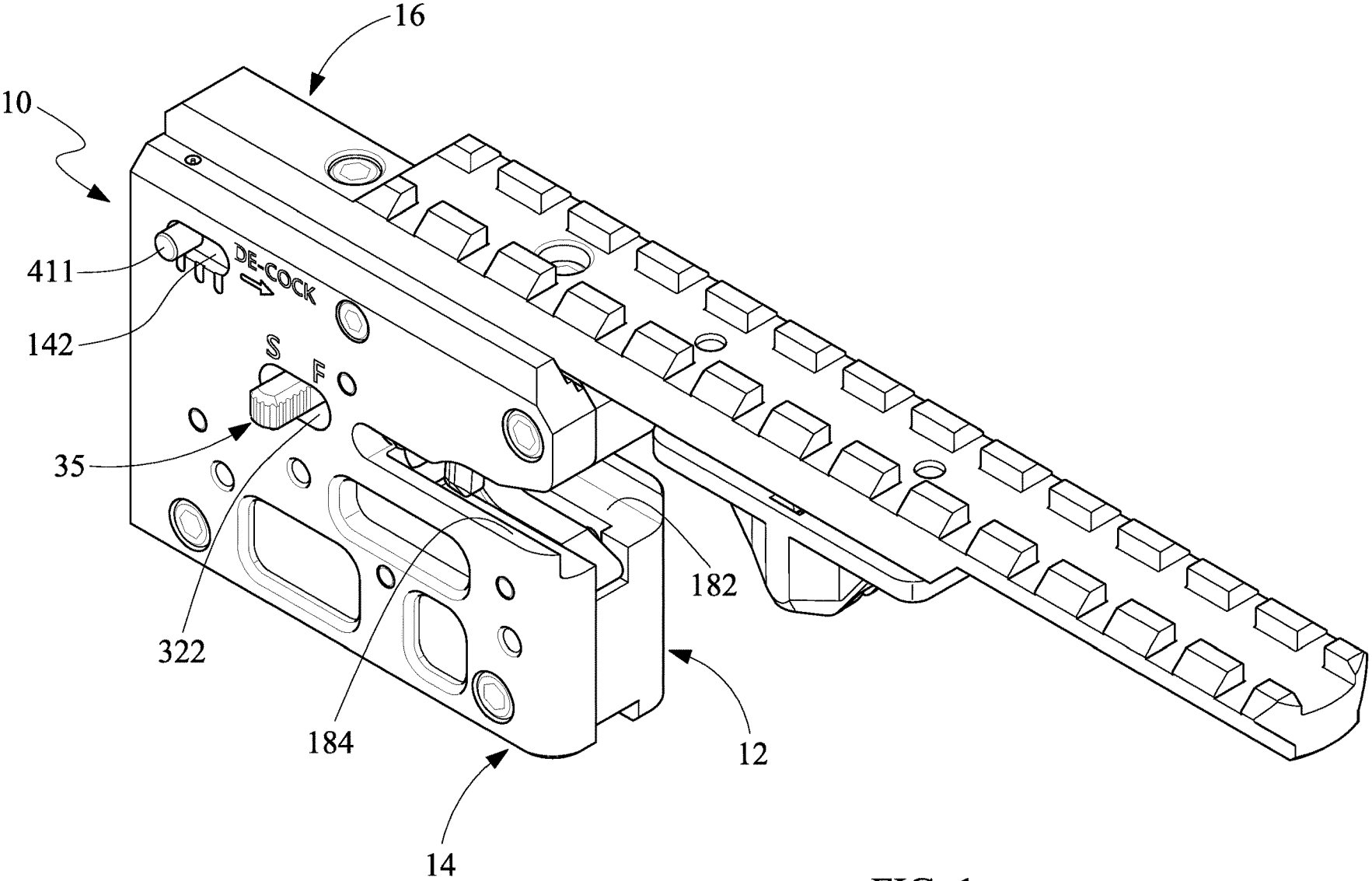
FIG. 1 is a perspective view of a string-unloading apparatus according to the preferred embodiment of the present invention.

Referring to FIGS. 1 through 7, a string-unloading apparatus includes a box 10, a trigger assembly (not numbered), a safety assembly (not numbered) and a string-unloading unit (not numbered) according to the preferred embodiment of the present invention.

In use, the box 10 is connected to a barrel of a crossbow (not shown). The box 10 includes two joined shells 12 and 14 and a cover 16 connected to an upper portion of the shell 12. Each of the shells 12 and 14 includes a slit 182. The box 10 include a groove 184 in communication with the slits 182.

The shell 12 (the prior art) includes a recess 121 and first, second and third pivots 1221, 1222 and 1223.

Figure 4:
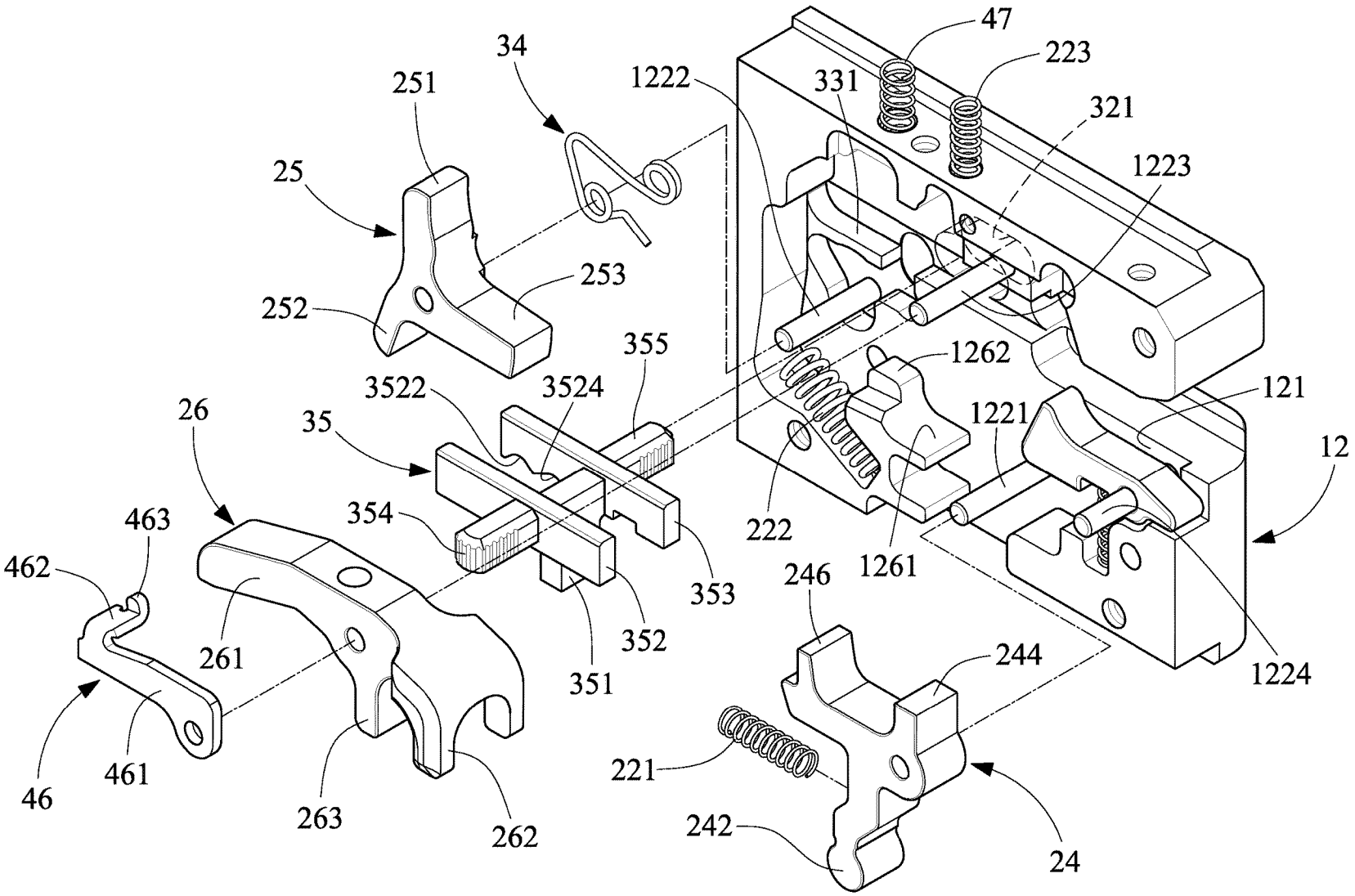
FIG. 4 is an exploded view of the portion of the string-unloading apparatus shown in FIG. 3.

Referring to FIG. 4, the recess 121 is cut in an internal side of the shell 12 pointed at an internal side of the shell 14.

The first, second and third pivots 1221, 1222 and 1223 are located in recess 121.

The shell 14 (the prior art) includes a recess 141, a string-unloading aperture 142, a string-unloading slot 143 and a groove 144.

The recess 141 is cut in the internal side of the shell 14.

The string-unloading aperture 142 transversely extends throughout the shell 14. The recess 141 is in communication with the exterior of the box 10 via the spring-releasing aperture 142.

The string-unloading slot 143 transversely extends throughout the shell 14. The string-unloading slot 143 horizontally extends along the shell 14. The recess 141 is in communication with the exterior of the box 10 via the spring-releasing slot 143.

The groove 144 is cut in the internal side of recess 141. The groove 144 is in communication with the recess 141. The groove 144 is tapered as it vertically extends downward.

Figure 2:
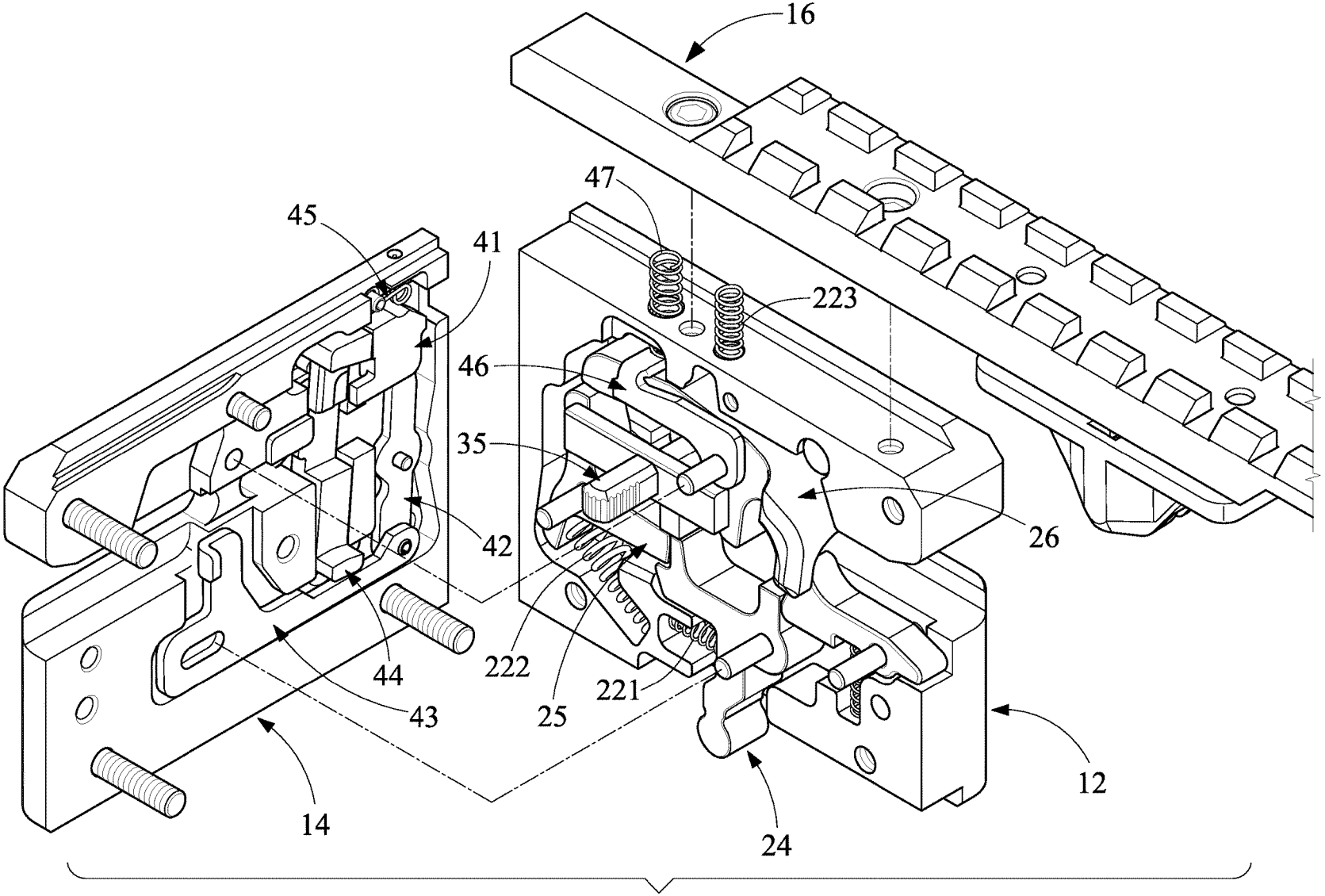
FIG. 2 is an exploded view of the string-unloading apparatus shown in FIG. 1.
Figure 3:
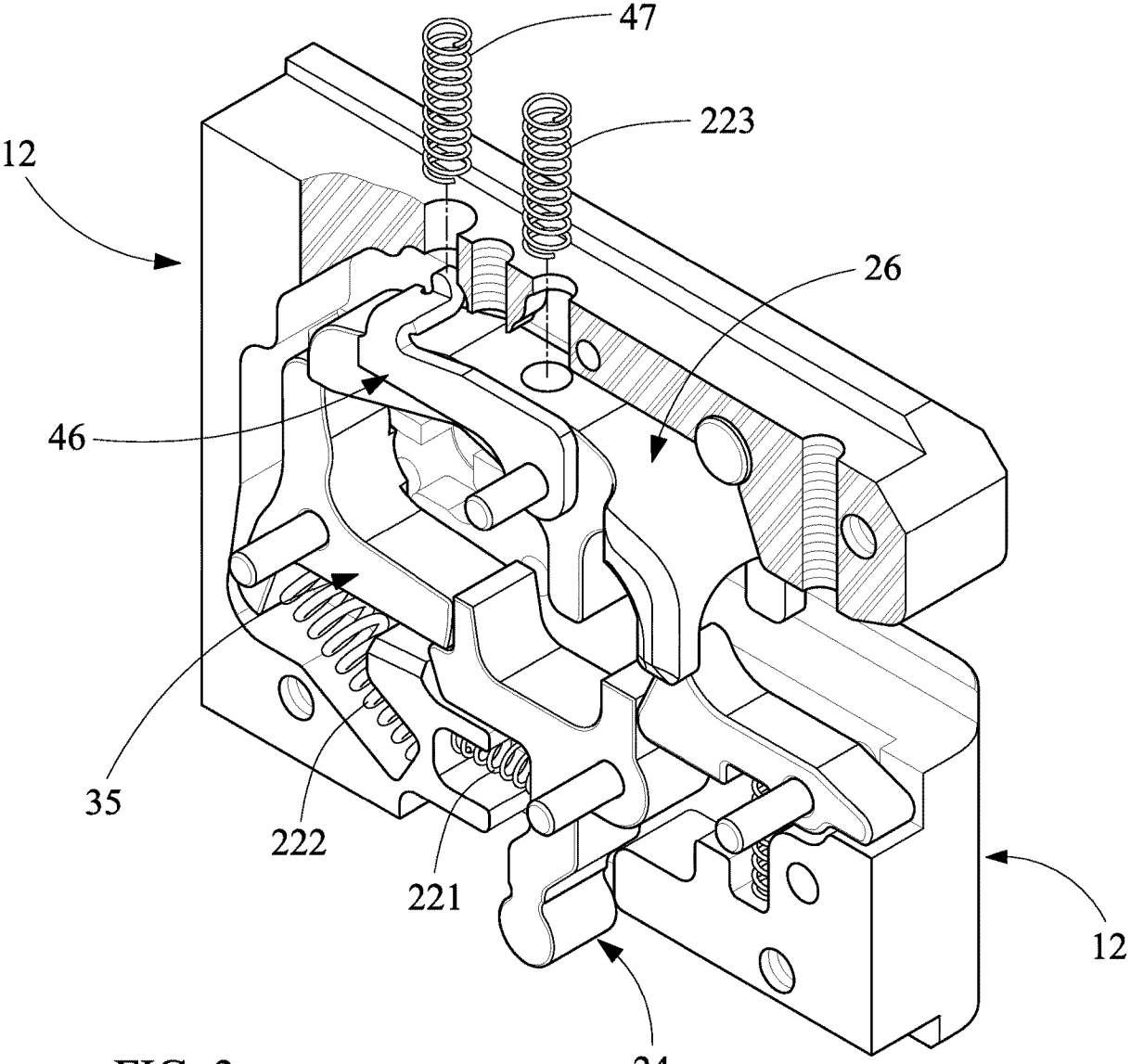
FIG. 3 is a perspective view of a portion of the string-unloading apparatus shown in FIG. 2.

Referring to FIGS. 2 through 4, the trigger assembly (the prior art) is connected to the shell 12 and located in the recess 121. The trigger assembly includes first, second and third springs 221, 222, 223, a primary trigger 24, a locking element 25 and a string-hooking element 26. The primary trigger 24 can be called "internal trigger" and is connected to a secondary or external trigger (not shown) extending from the crossbar. The secondary trigger can be pulled to move the primary trigger 24.

Referring to FIGS. 2 through 4, the primary trigger 24 includes a T-shaped body 242 and protuberances 244 and 246.

The T-shaped body 242 includes a horizontal section and a vertical section. A front end of the horizontal section of the T-shaped body 242 is pivotally connected to the pivot 1221. The vertical section of the T-shaped body 242 extends to the exterior of the box 10. A lower end of the vertical section of the T-shaped body 242 of the primary trigger 24 is connected to the secondary trigger. The spring 221 biases the vertical portion of the T-shaped body 242 so that a rear end of the horizontal section of the T-shaped body 242 is away from a first restricting portion 1261 of the internal side of the shell 12 in the recess 121.

The protuberances 244 and 246 extend upward from the horizontal section of the T-shaped body 242. The protuberances 244 and 246 are respectively located adjacent to the ends of the horizontal section of the T-shaped body 242.

Referring to FIGS. 2 through 4, the locking element 25 is pivotally connected to the pivot 1222. The locking element 25 includes a branch 251 extending upward, a branch 252 extending downward, and a branch 253 extending forward. The branch 252 is biased by the spring 222 so that the branch 253 is selectively pressed against a second restricting portion 1262 and the primary trigger 24 (the second end of the horizontal section of the T-shaped body 242).

Referring to FIGS. 2 through 4, the string-hooking element 26 is pivotally connected to the pivot 1223. The string-hooking element 26 includes a bar 261, two claws 262 and a protrusion 263.

The claws 262 extend downward from a front section of the bar 261.

The protrusion 263 extends downward from a middle section of the bar 261. The string-hooking element 26 is biased by the third spring 223. Thus, the front section of the bar 261 of the string-hooking element 26 is pressed against the internal side of the shell 12 in the recess 121. Moreover, a rear section of the bar 261 is pressed against the branch 251 of the locking element 25.

Referring to FIGS. 1 through 4, the safety assembly (the prior art) is located in a chamber in the box 10, which is a combination of the recess 121 of the shell 12 with the recess 141 of the shell 14. The safety assembly includes two slots 321 and 322, two grooves 331 and 332, an elastic restraining element 34 and a safety 35.

Figure 5:
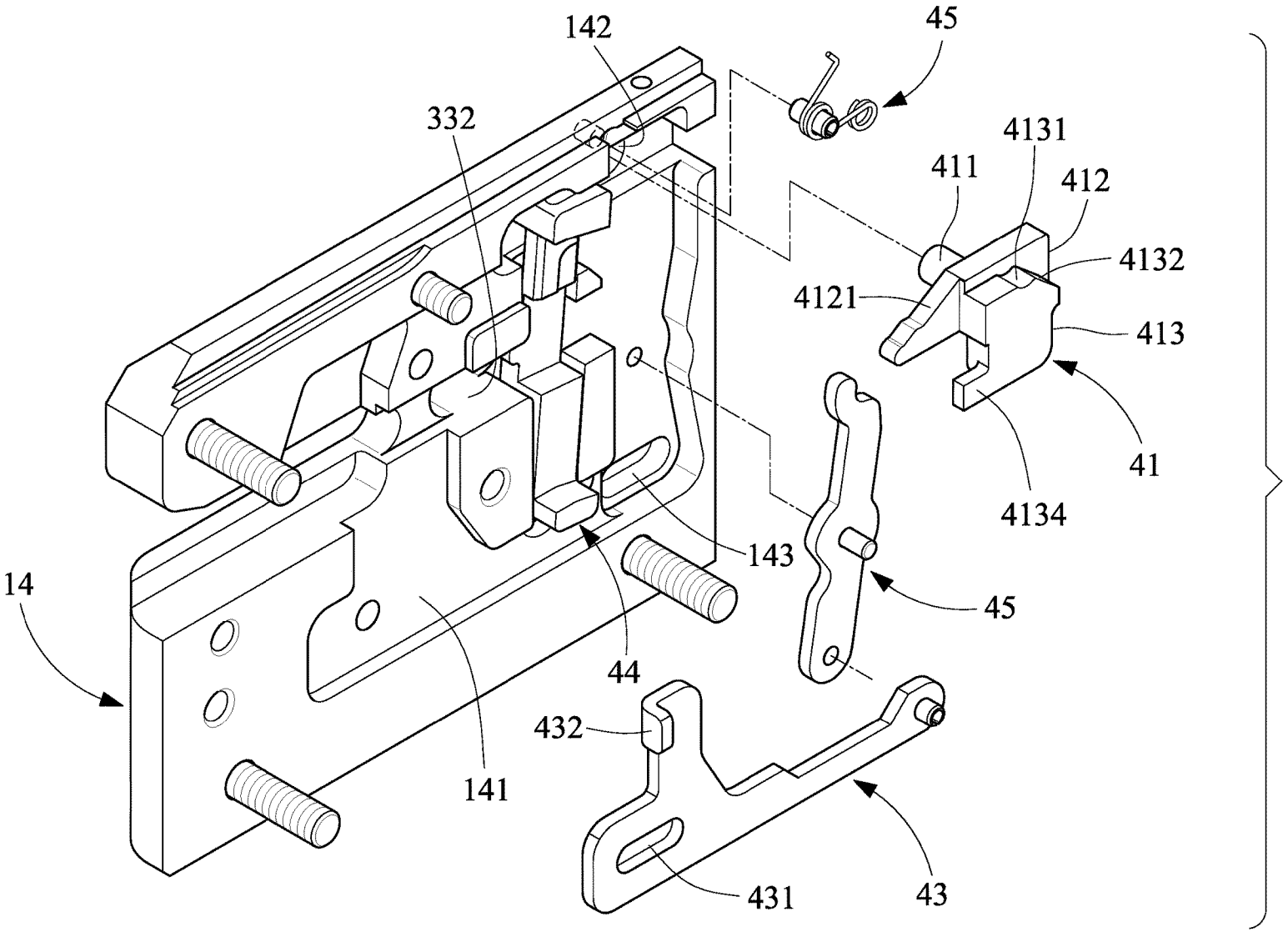
FIG. 5 is a perspective view of another portion of the string-unloading apparatus shown in FIG. 2.
Figure 6:
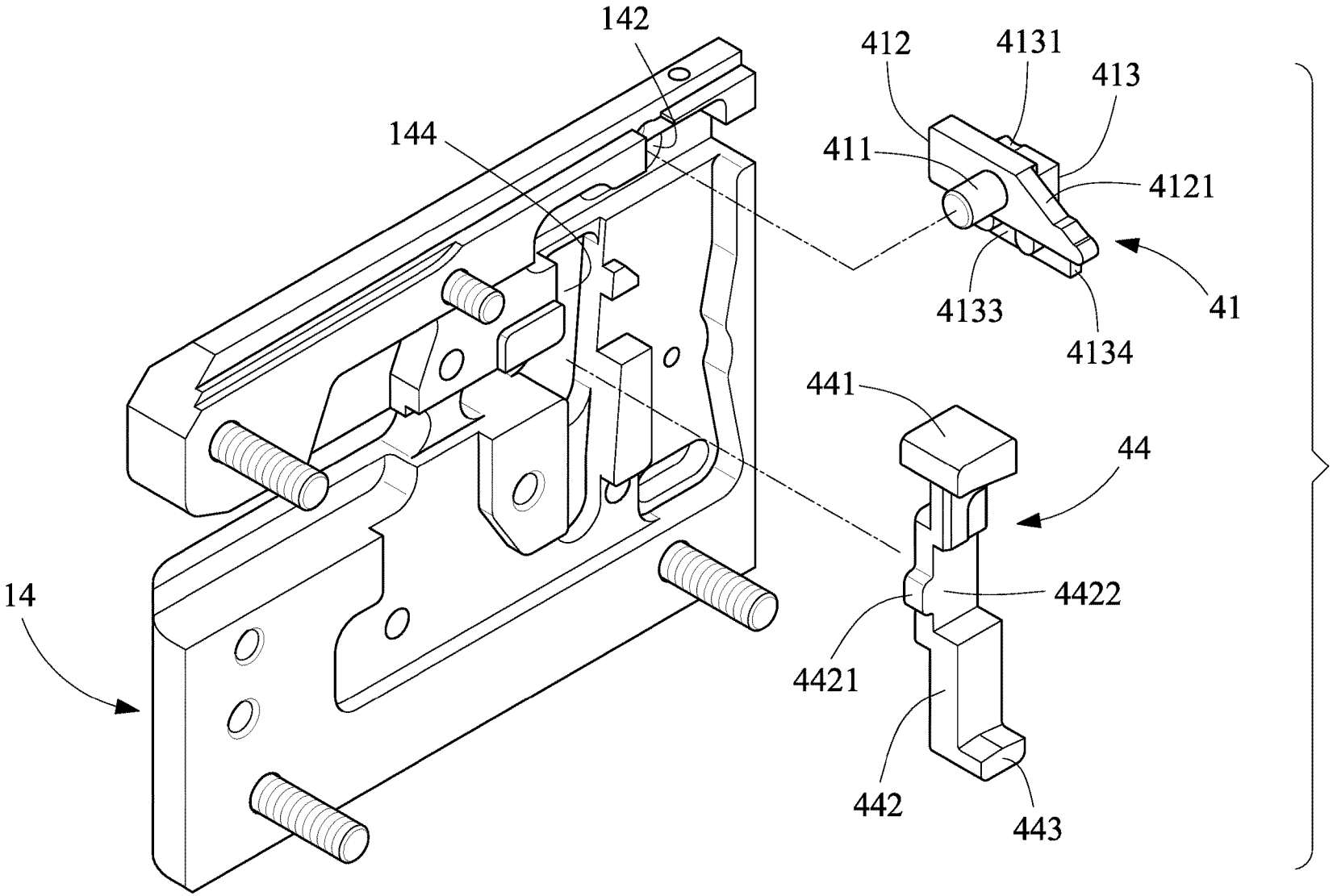
FIG. 6 is an exploded view of the portion of the string-unloading apparatus shown in FIG. 5.
Figure 7:
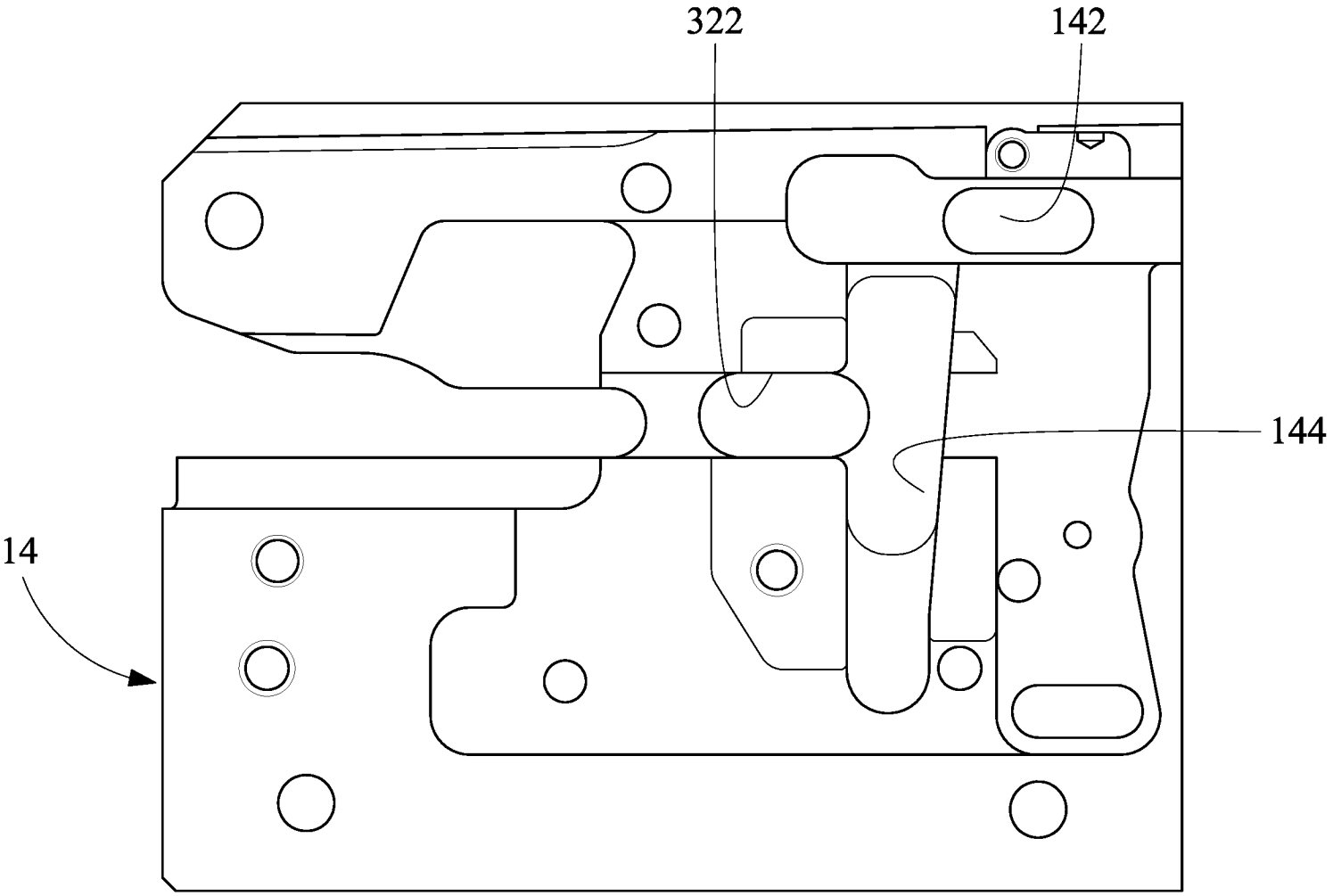
FIG. 7 is a side view of the portion of the string-unloading apparatus shown in FIG. 5.

Referring to FIGS. 4 through 6, the slots 321 and 322 are respectively cut in the shells 12 and 14.

The groove 331 is cut in the internal side of the shell 12 in the recess 121. The groove 331 is in communication with the slot 321. The groove 332 is cut in the internal side of the shell 14 in the recess 141. The groove 332 is in communication with the slot 322.

Referring to FIG. 4, the elastic restraining element 34 includes a helical section extending around the pivot 1222. An end of the elastic restraining element 34 extends in the groove 331.

Referring to FIGS. 1 through 4, the safety 35 is movable between a locking position and an unlocking position. The safety 35 includes a locking portion 351, two sliding portions 352 and 353 and two handles 354 and 355.

The sliding portions 352 and 353 are formed on two opposite sides of the locking portion 351 so that the former extend in perpendicular to the latter. The first and second bars 261 and 263 of the string-hooking element 26 are located in a gap between the sliding portions 352 and 353. The sliding portions 352 and 353 are respectively movable in the grooves 331 and 332. At least one of the sliding portions 352 and 353 includes two positioning dents 3522 and 3524 in a lower face. When the safety 35 is in the locking position, the positioning dent 3522 receives the end of the elastic restraining element 34. When the safety 35 is in the unlocking position, the positioning dent 3524 receives the end of the elastic restraining element 34.

Each of the handles 354 and 355 extends from an external side of a corresponding one of the sliding portions 352 and 353. The handles 354 and 355 are respectively movable in the slots 321 and 322. The handles 354 and 355 extend to the exterior of the box 10 via the slots 321 and 322. In the locking position, the locking portion 351 of the safety 35 abuts against the protuberance 246 of the primary trigger 24 to prevent the primary trigger 24 from pivoting. In the unlocking position, the locking portion 351 of the safety 35 resides between the protuberances 244 and 246 of the primary trigger 24 to allow the primary trigger 24 to pivot.

Referring to FIGS. 1, 2 and 5 through 7, the string-unloading unit includes a switch 41, a lever 42, a pulling element 43, an oar 44, a torque spring 45, a restraining element 46 and a compression spring 47.

The switch 41 is movable in the recess 141 between a safe position, a preparatory position and a string-unloading position. The switch 41 includes a handle 411, a portion 412 and a portion 413.

The portion 412 includes a slope 4121. The slope 4121 preferably includes two steps.

The handle 411 extends from a side of the portion 412. The handle 411 includes a free end extending from the box 10 via the string-unloading aperture 142 of the shell 14. Thus, the handle 411 is operable to move the switch 41 between the safety position, the preparatory position and the string-unloading position.

The portion 413 is formed on an opposite side of the portion 412. The portion 413 includes a dent 4131, a slope 4132, a cutout 4133 (FIG. 8) and an abutment portion 4134.

The dent 4131 is cut in an upper face of the portion 413.

The slope 4132 is formed on the upper face of the portion 413, next to the dent 4131.

The cutout 4133 is cut in a lower face of the portion 413.

The abutment portion 4134 extends from a front face of the portion 413.

The lever 42 is pivotally connected to the internal side of the shell 14 in the recess 141. The spring-releasing lever 42 includes an upper end inserted in the cutout 4133 of the portion 413 so that the switch 41 is operable to pivot the lever 42.

The pulling element 43 is movable in the recess 141. A rear end of the pulling element 43 is pivotally connected to a lower end of the lever 42. The pulling element 43 includes a slot 431 and a tab 432 adjacent to a front end. The slot 431 longitudinally extends in the pulling element 43.

The slot 431 receives the pivot 1221. Thus, the pulling element 43 is smoothly movable.

The tab 432 transversely extends from a protuberance extending upward from the pulling element 43. The tab 432 is selectively pushed by the protrusion 263 of the string-hooking element 26 so that the pulling element 43 is moved.

The oar 44 is movable up and down and forward and backward in the groove 144. The oar 44 includes a plate 441, a bar 442 and a hook 443.

The bar 442 includes an extensive portion 4421 extending from a front face and a recess 4422 cut in a side. The extensive portion 4421 of the bar 442 selectively abuts against the handle 354 of the safety 35 when the oar 44 is movable in the groove 144. The recess 4422 of the bar 442 receives the sliding portion 352 of the safety 35 when the oar 44 is movable in the groove 144.

The plate 441 of the oar 44 includes a lower face formed with a slope (FIG. 8) in contact with the slope 4121 of the portion 412 of the switch 41. Thus, horizontal movement of the switch 41 causes vertical movement of the oar 44.

The hook 443 selectively hooks and hence pivots the locking element 25 to cause the string-hooking element 26 to release a string when the oar 44 is moved upward in the groove 144.

The torque spring 45 is pivotable in the recess 141. The torque spring 45 includes a first end in contact with the internal side of the shell 14 in the recess 141 and a second end movable between the dent 4131 and the slope 4132.

An end of the restraining element 46 is pivotally connected to the shell 12. The restraining element 46 is in contact with the string-hooking element 26 so that they are selectively movable together. Another end of the restraining element 46 is selectively movable to the string-unloading position with the switch 41. The restraining element 46 includes a contact portion 461, a tab 462 and a boss 463.

A front end of the contact portion 461 is pivotally connected to the pivot 1223 of the shell 12, in contact with a side of the string-hooking element 26.

The tab 462 transversely from a rear end of the contact portion 461. The tab 462 is located against an upper face of the string-hooking element 26.

The boss 463 extends upward from the tab 462.

The compression spring 47 includes an end extending around the boss 463 and another end pressed against the internal side of the shell 14 in the recess 141. The compression spring 47 biases the tab 462 toward the string-hooking element 26.

Figure 8:
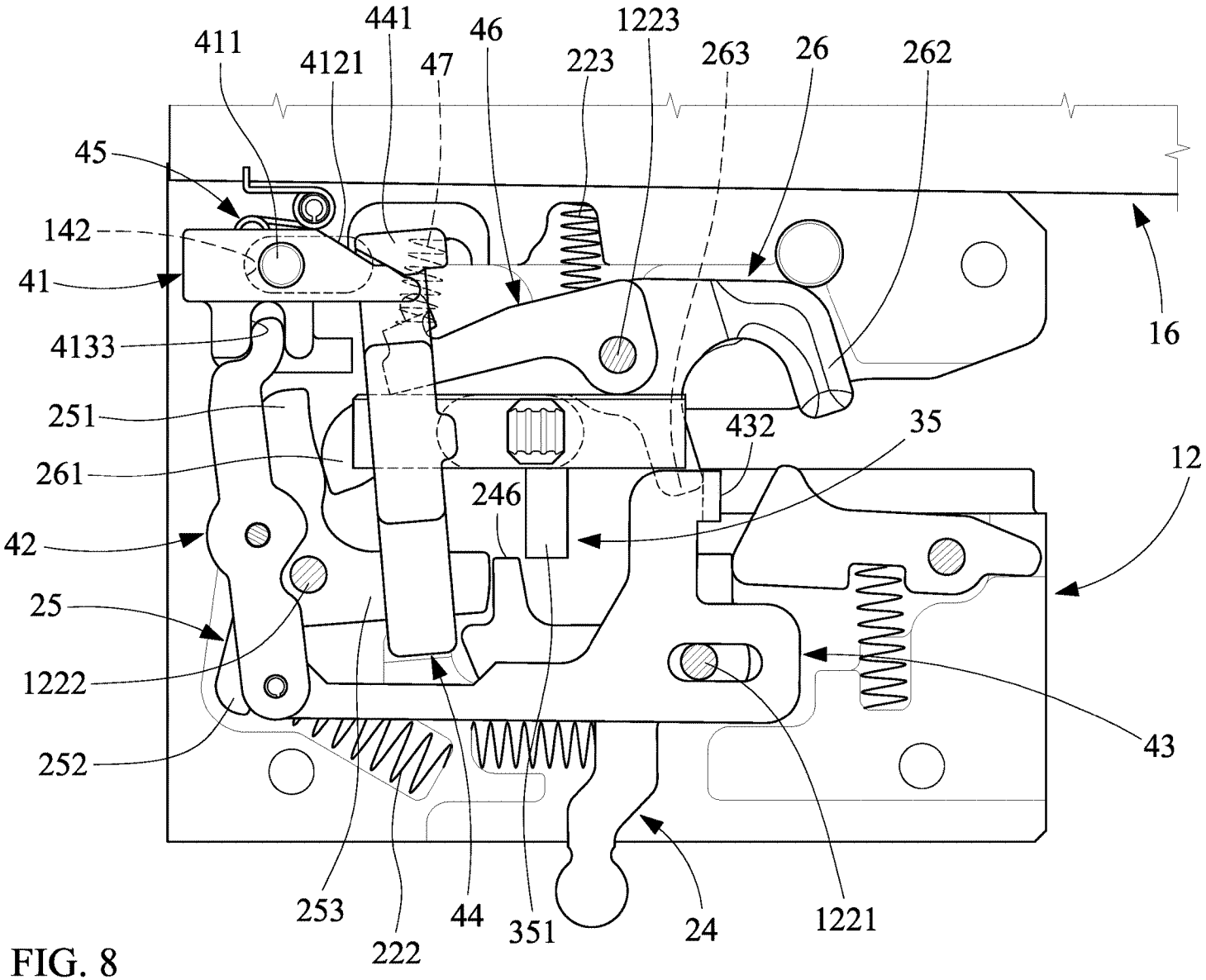
FIG. 8 is a side view of the string-unloading apparatus shown in FIG. 1.
Figure 9:
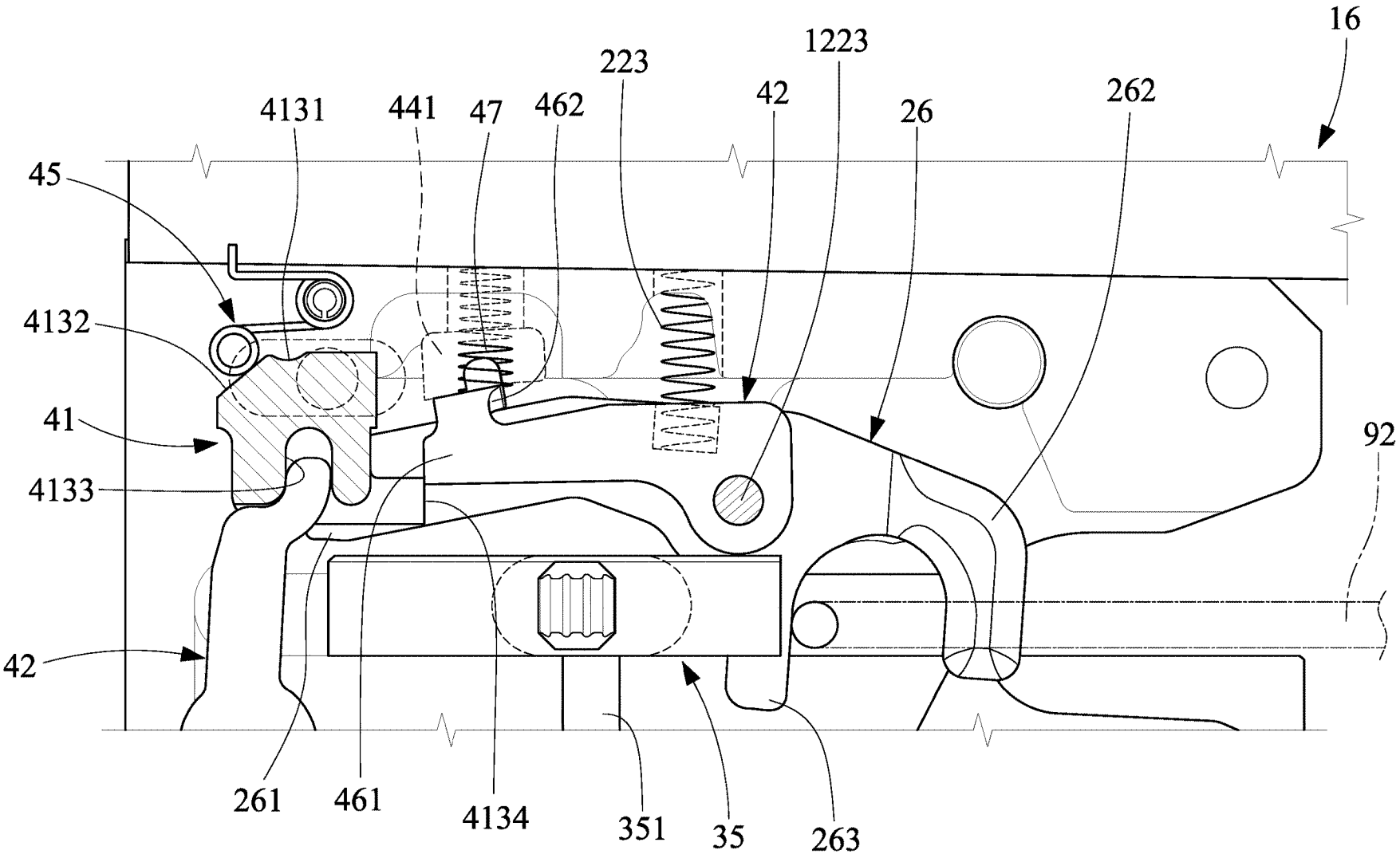
FIG. 9 is an enlarged partial view of the string-unloading apparatus shown in FIG. 8.
Figure 10:
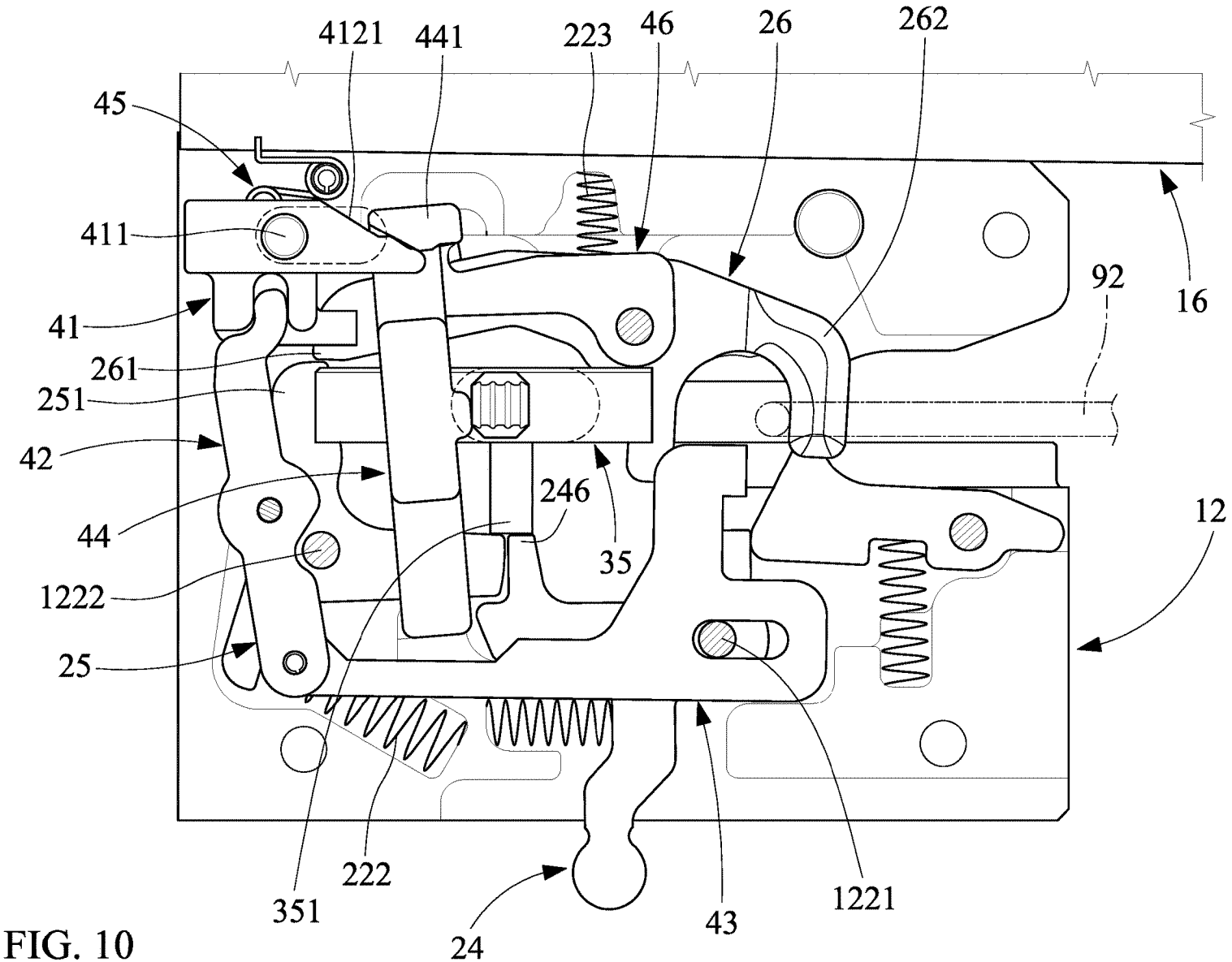
FIG. 10 is a side view of the string-unloading apparatus shown in FIG. 1 when a string is loaded.
Figure 11:
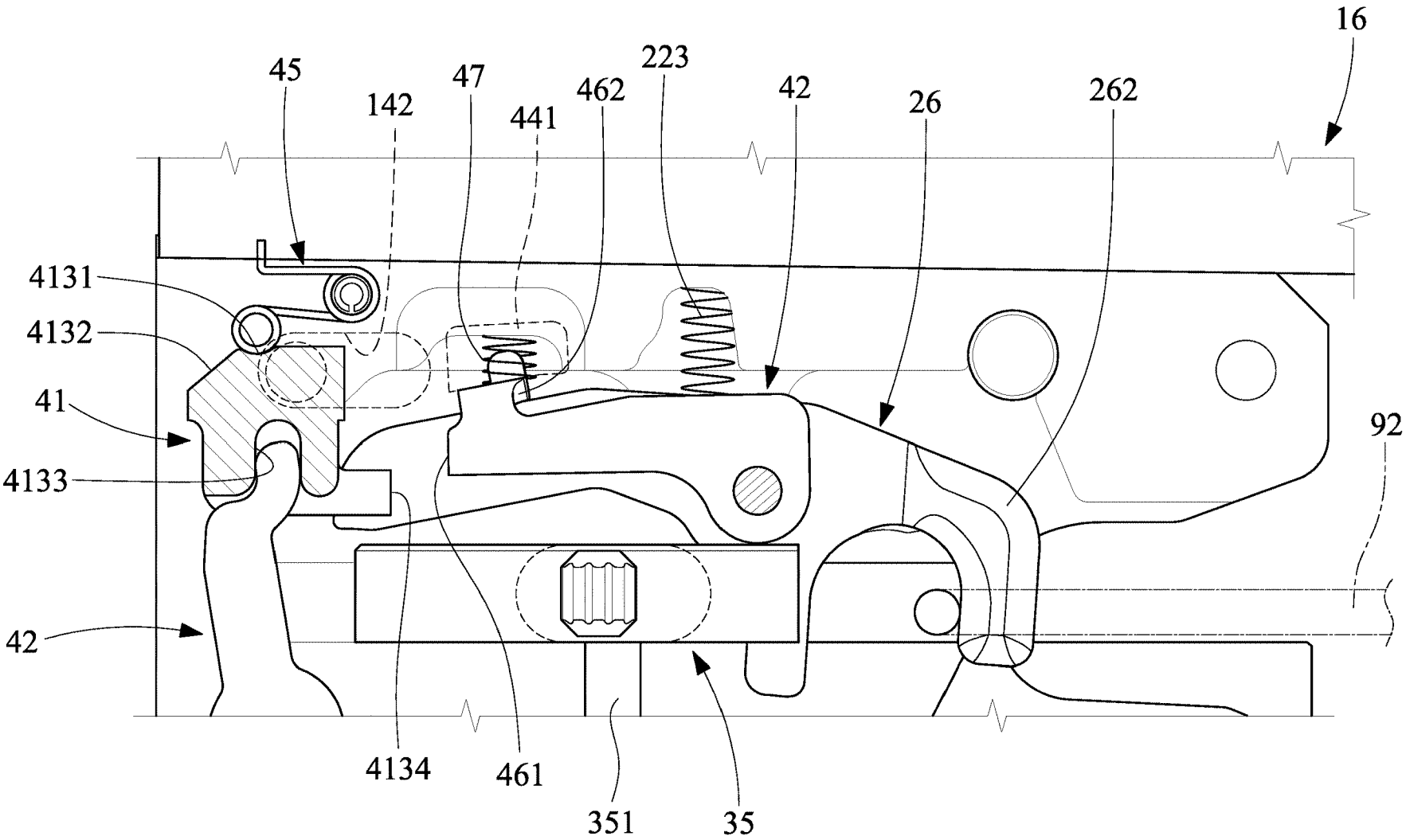
FIG. 11 is an enlarged partial view of the string-unloading apparatus shown in FIG. 10.

Referring to FIG. 8, the switch 41 is normally in the safety position. The bar 261 of the string-hooking element 26 is biased by the third spring 223 to lift the claws 262 of the string-hooking element 26. A rear section of the bar 261 of the string-hooking element 26 abuts against a front face of the branch 251 of the locking element 25.

Then, the protrusion 263 of the string-hooking element 26 pushes the tab 432 of the pulling element 43, thereby moving the pulling element 43 forward. Accordingly, the lever 42 is pivoted about the pivot 1222 to move the switch 41 backward to the safety position.

The switch 41 reaches the safety position so that the second end of the torque spring 45 is located in the dent 4131 of the portion 413 of the switch 41, thereby keeping the switch 41 in the safety position. The compression spring 47 biases the restraining element 46 against the string-hooking element 26.

Referring to FIGS. 8 through 12, cocking and locking of a string 92 will be described. A cocking device (not shown) is used to pull the string 92 into the box 10 via the groove 184. A middle section of the string 92 pushes the protrusion 263 of the string-hooking element 26 to pivot the string-hooking element 26 about the pivot 1223. The rear section of the bar 261 of the string-hooking element 26 is lifted away from the branch 251 of the locking element 25 to allow the spring 222 to push the branch 252 of the locking element 25 to rotate the locking element 25 about the pivot 1222. Thus, a free end of the branch 251 of the locking element 25 abuts against the rear section of the bar 261 of the string-hooking element 26. In addition, a lower face of the branch 253 of the locking element 25 contacts an upper face of the horizontal section of the T-shaped body 242 of the primary trigger 24.

Moreover, the front section of the bar 261 is lowered so that the protrusion 263 moves the safety 35 by the locking portion 351 to the locking position from the unlocking position. Thus, the elastic restraining element 34 is moved into the positioning dent 3524 from the positioning dent 3522. The locking portion 351 of the safety 35 is located above the protuberance 246 of the primary trigger 24. The cocking device is disabled to allow the string 92 to be hooked by the claws 262 of the string-hooking element 26. The claws 262 cannot be lifted to release the string 92 because the rear section of the bar 261 is restrained by the free end of the branch 251 of the locking element 25.

Moreover, the locking portion 351 of the safety 35 is located on the protuberance 246 of the primary trigger 24. Thus, the archer is not allowed to pivot the primary trigger 24.

Figure 12:
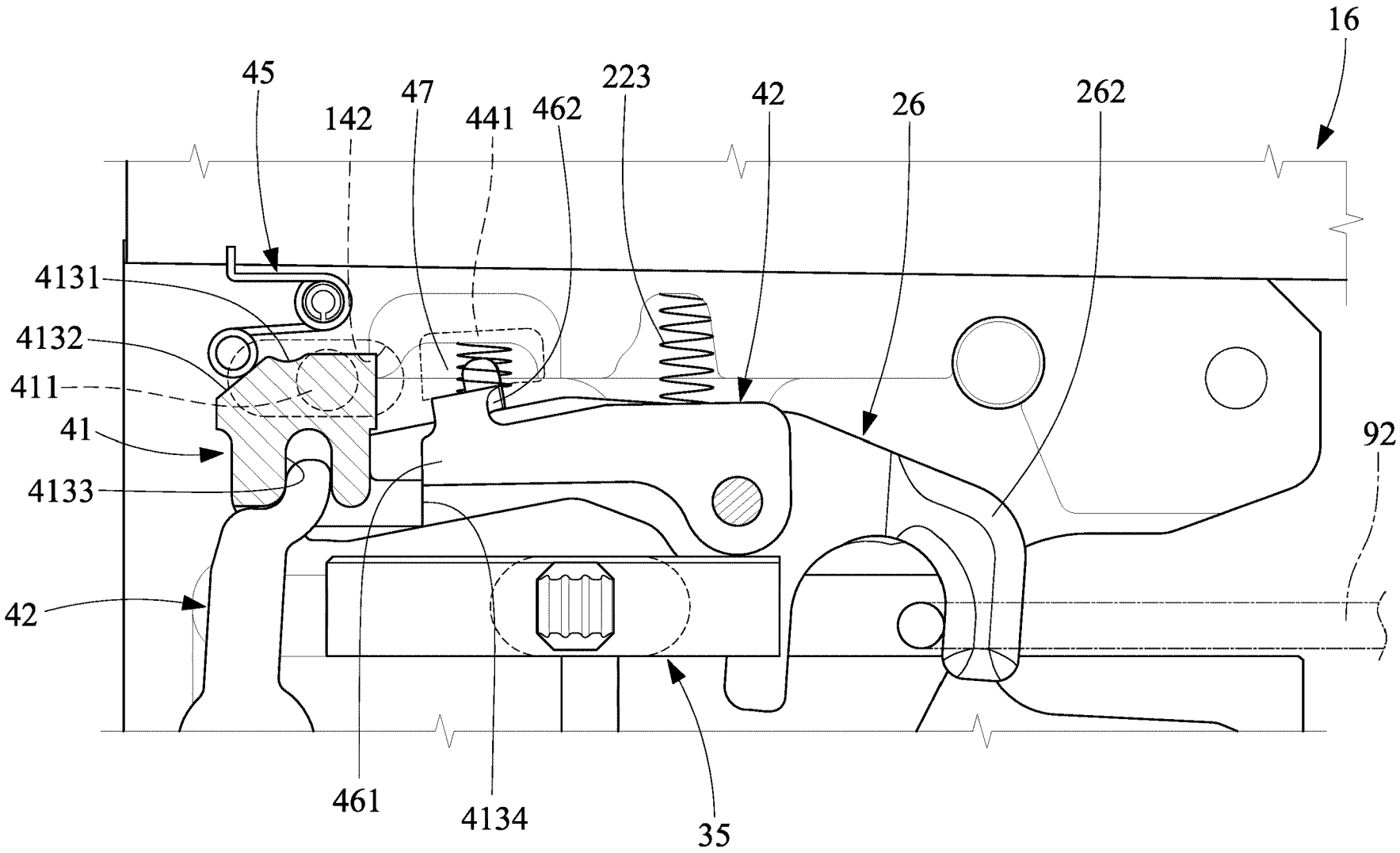
FIG. 12 is an enlarged partial view of the string-unloading apparatus in another position than shown in FIG. 11.
Figure 13:
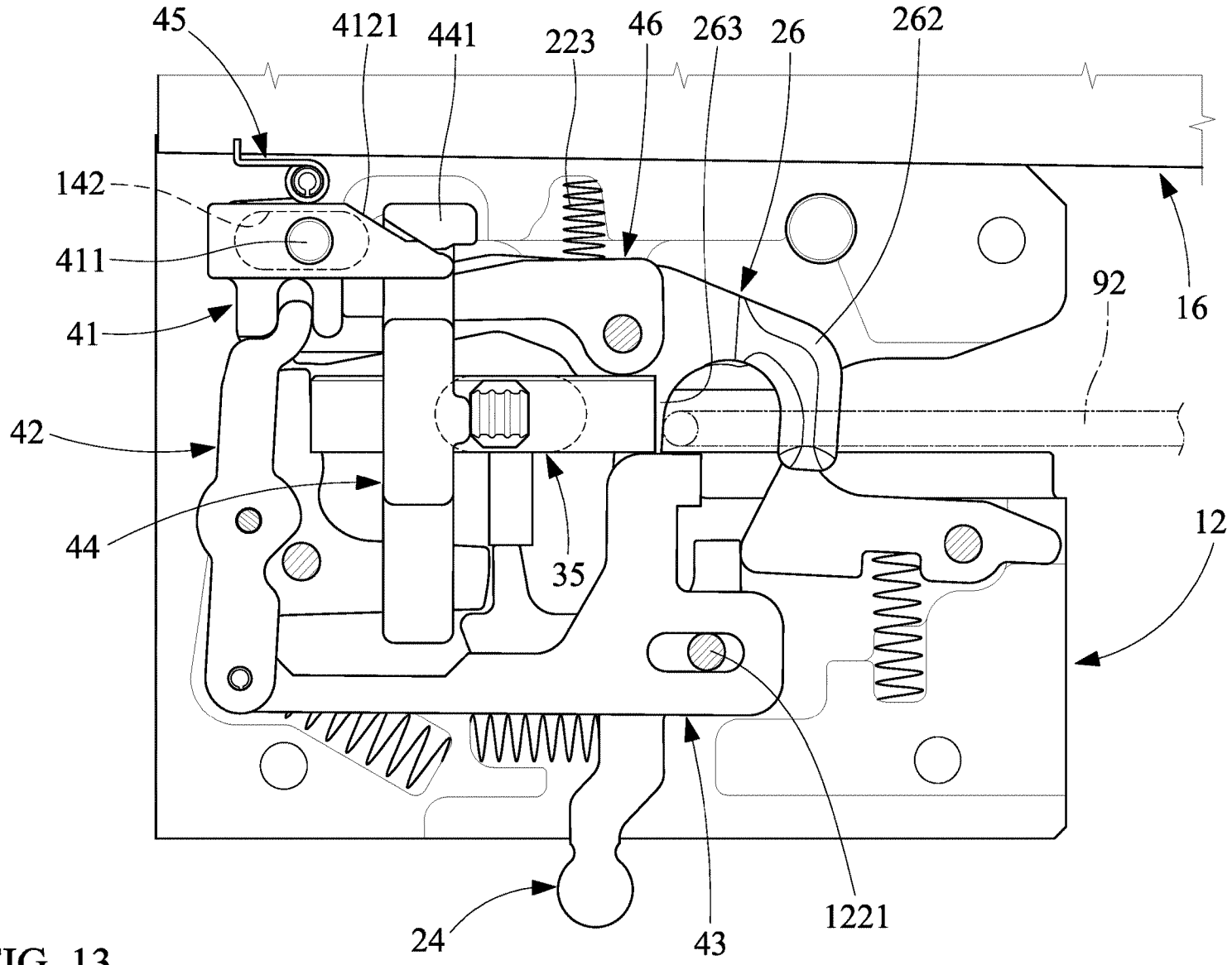
FIG. 13 is a side view of the string-unloading apparatus shown in FIG. 10 when the string is further loaded.
Figure 14:
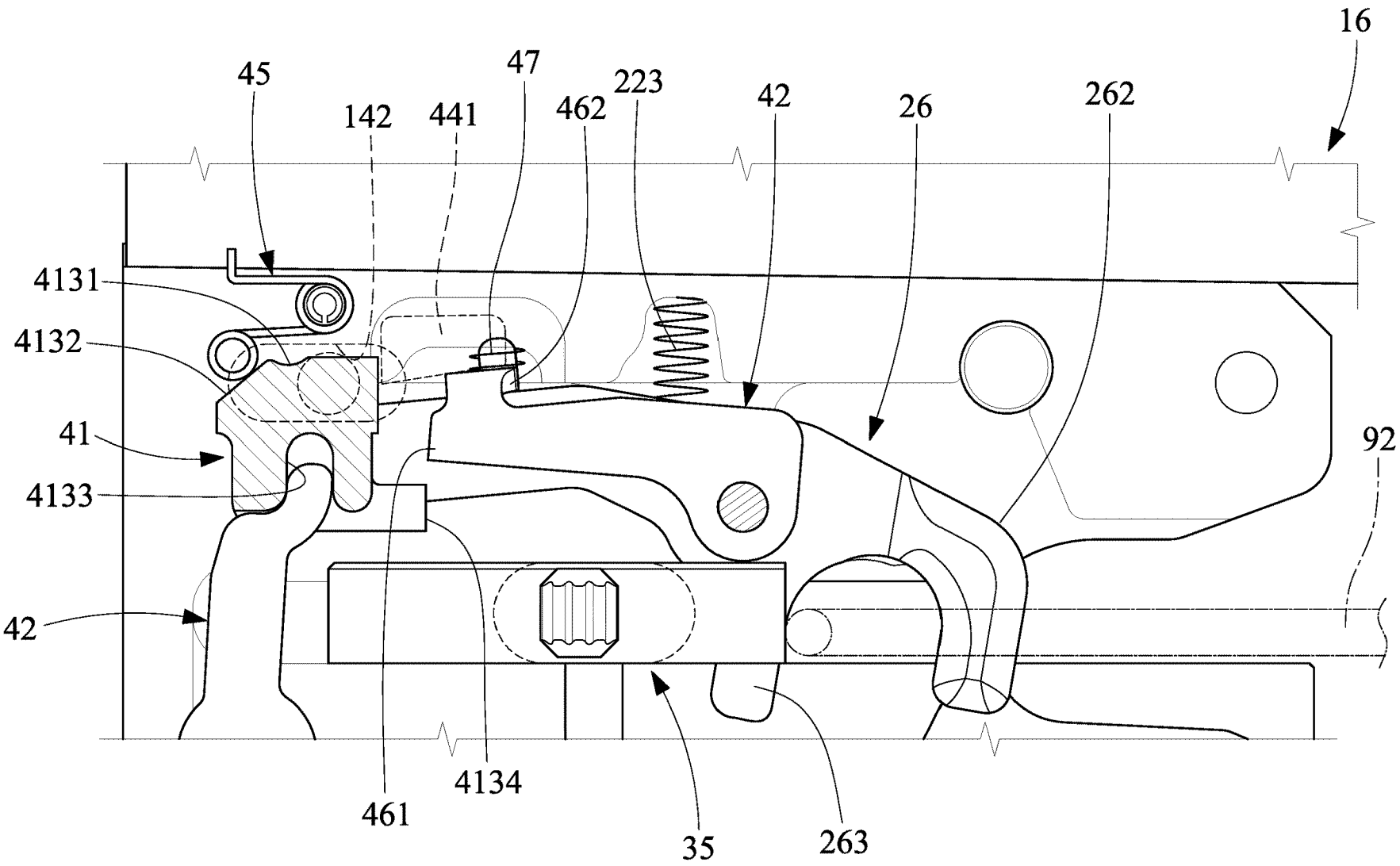
FIG. 14 is an enlarged partial view of the string-unloading apparatus shown in FIG. 13.
Figure 15:
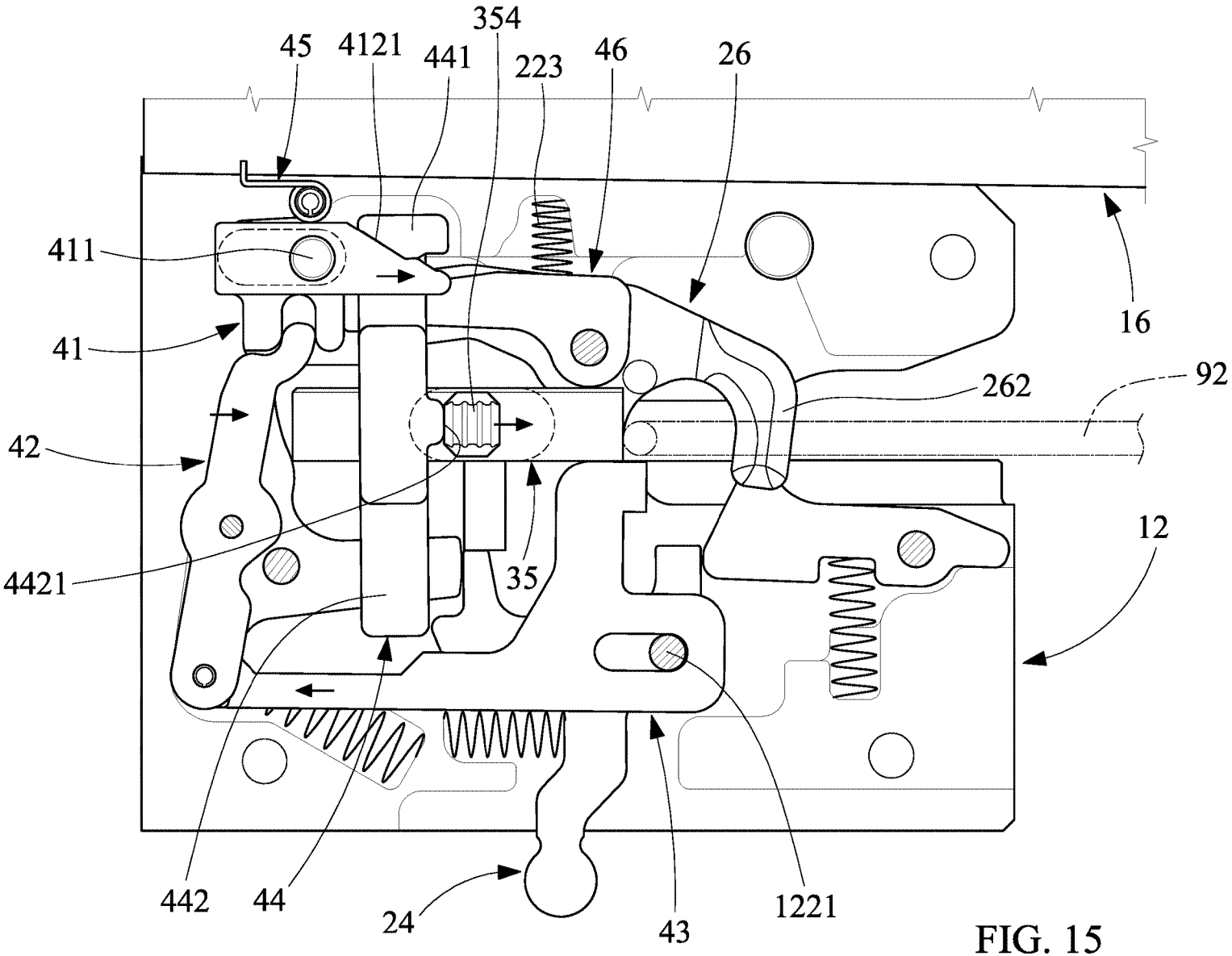
FIG. 15 is a side view of the string-unloading apparatus depicted in FIG. 1 when the string is unloaded.
Figure 16:
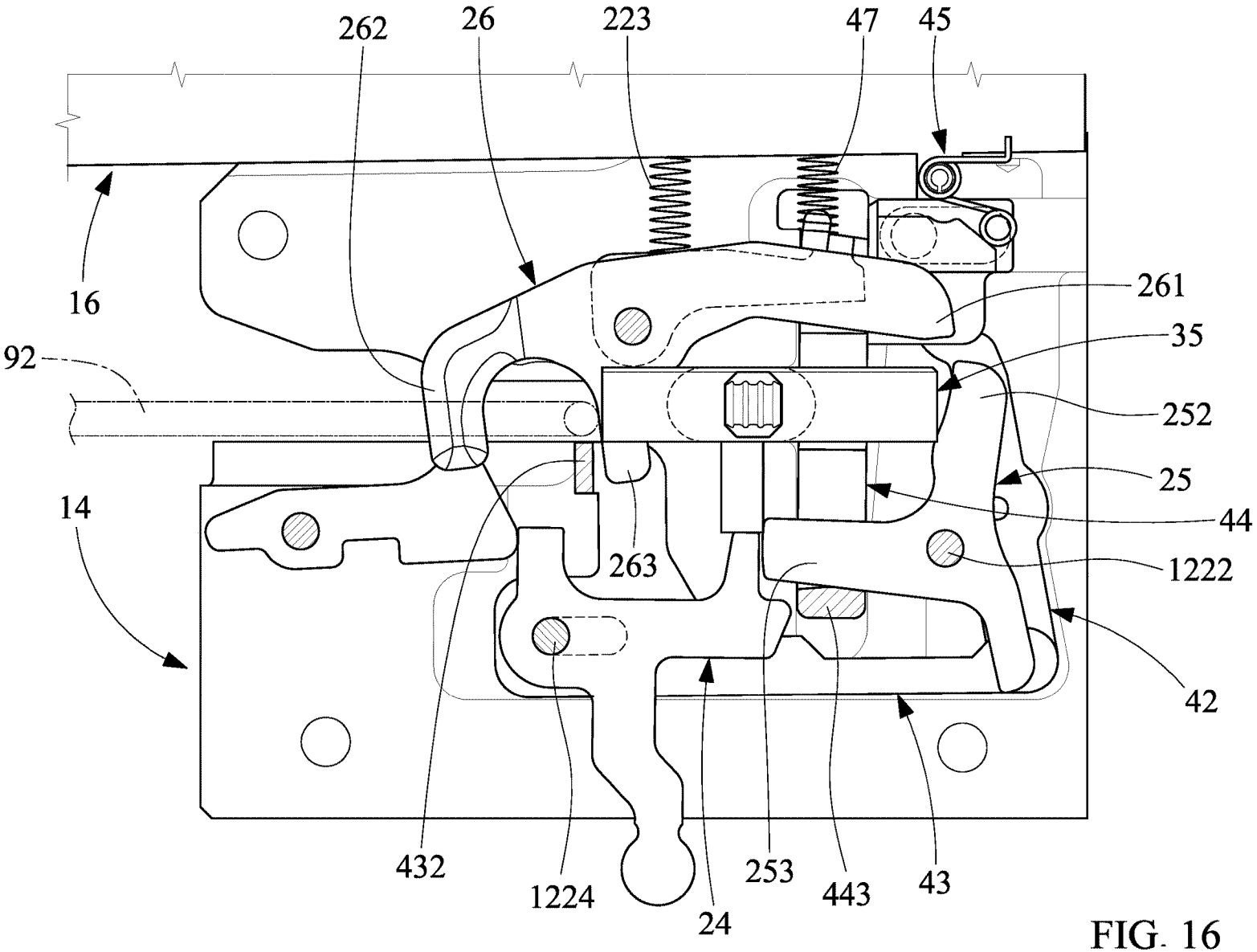
FIG. 16 is another side view of the string-unloading apparatus shown in FIG. 1 when the string is unloaded.
Figure 17:
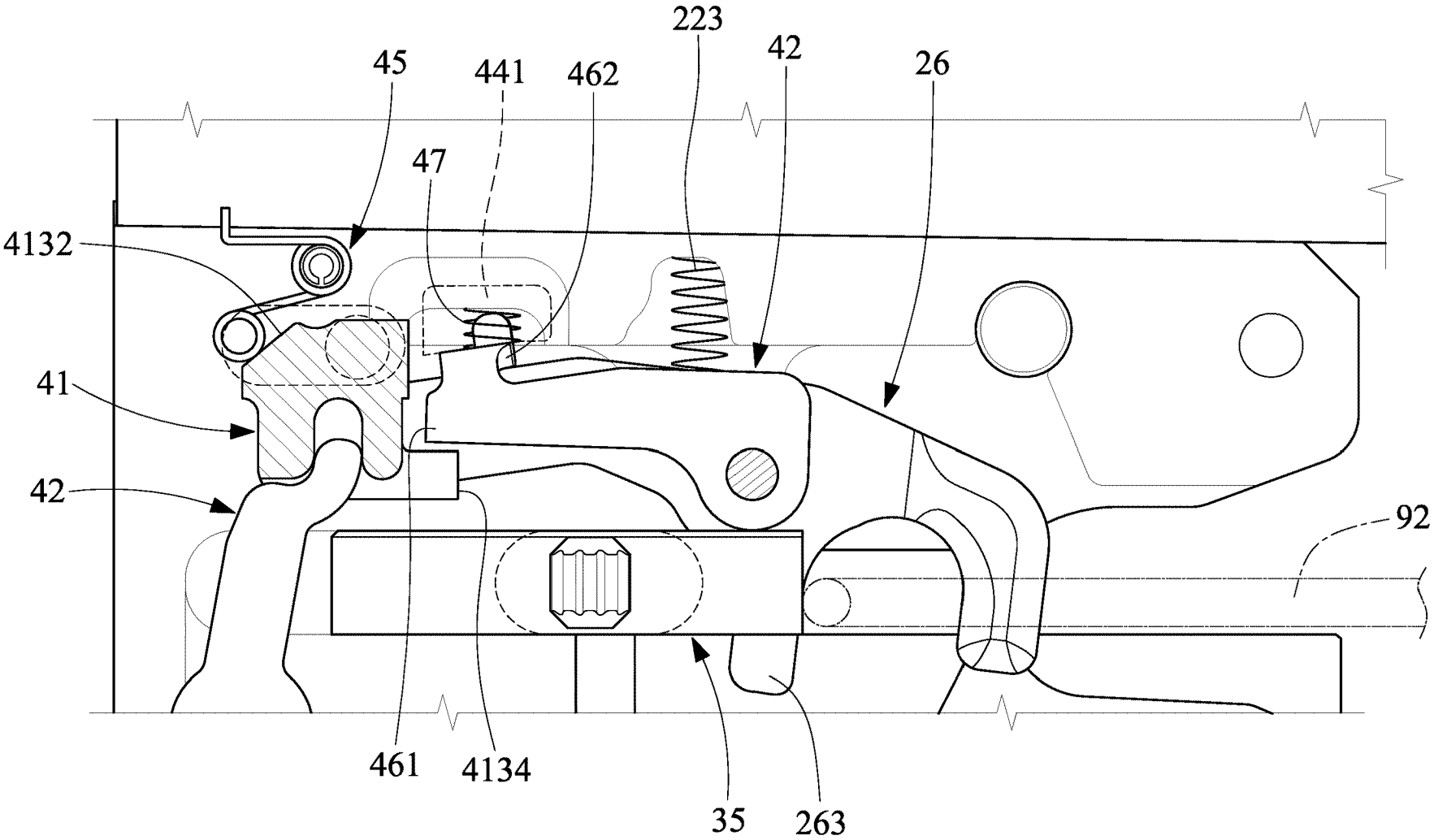
FIG. 17 is an enlarged partial view of the string-unloading apparatus shown in FIG. 15.

Referring to FIG. 12, the string-unloading apparatus is moved to the preparatory position. To unload the string 92, the archer moves the switch 41 by the free end of the handle 411 to the preparatory position from the safety position.

When the switch 41 is in the preparatory position, a free end of the abutment portion 4134 of the switch 41 is abutted against a rear end of the restraining element 46 so that the switch 41 is prevented from moving forward any further. Now, the torque spring 45 is moved to the slope 4132 of the switch 41 from the dent 4131 of the switch 41. Thus, the switch 41 is in tendency to move to the string-unloading position.

Moreover, the slope 4121 of the switch 41 abuts against the slope of the plate 411 of the oar 44. Thus, the oar 44 is lifted a little.

Now, the safety 35 is still in the locking position so that the primary trigger 24 cannot be pivoted to cause the string-hooking element 26 to release the string 92.

Referring to FIGS. 13 through 17, the witch 41 is moved to the string-unloading position from the preparatory position by using the cocking device to pull the string 92 slightly. The section of string 92 pushes the protrusion 263 of the string-hooking element 26 so that the string-hooking element 26 is pivoted and that the rear section of the bar 261 of the string-hooking element 26 is lifted. The rear section of the bar 261 of the string-hooking element 26 lifts the tab 462 of the restraining element 46 so that the restraining element 46 is pivoted. Thus, the free end of the abutment portion 4134 of the switch 41 is free from the rear end of the restraining element 46 so that the switch 41 is allowed to move to the string-unloading position.

Accordingly, the torque spring 45 pushes the switch 41 to the string-unloading position. In the process, the slope 4121 of the switch 41 slides relative to the slope of the plate 411 of the oar 44, thereby lifting the oar 44.

The slope 4121 of the switch 41 moves the oar 44 forward as well as upward. Thus, the oar 44 moves forward and upward in the groove 144.

As the oar 44 moves forward, the extensive portion 4421 of the bar 442 of the oar 44 lifts the safety 35 to the unlocking position from the locking position by the handle 354. Synchronously, the hook 443 of the oar 44 lifts the branch 253 of the locking element 25, thereby pivoting the locking element 25 about the pivot 1222 so that the bar 261 of the string-hooking element 26 is free from the branch 252 of the locking element 25. The third spring 223 pushes down the rear section of the bar 261 of the string-hooking element 26, thereby lifting the front section of the bar 261 of the string-hooking element 26 and causing the claws 262 to release the string 92.

Then, the archer uses the cocking device to pull the string 92. Thus, the archer is allowed to reduce the tension of the string 92 slowly. Hence, the archer uses only one hand to conveniently unload the string 92 without any risks of damaging the crossbow.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A string-unloading apparatus comprising:

a box (10) connected to a crossbow;

a trigger assembly connected to the box (10) and operable to control a string (92);

a switch (41) movable in the box (10) between a safety position, a preparatory position and a string-unloading position, wherein the switch (41) comprises a handle (411) extending from the box (10), a first slope (4121) and an abutment portion (4134) formed on a front face, a dent (4131) made in an upper face, a cutout (4133) made in a lower face, and a second slope (4132) formed on a rear face;

a lever (42) comprising an upper end inserted in the cutout (4133), a middle section pivotally connected to the box (10), and a lower end;

a pulling element (43) comprising a rear end pivotally connected to the lower end of the lever (42), a front end pivotally connected to the box (10), and a tab (432) for contact with the trigger assembly;

an oar (44) movable vertically and horizontally in the box (10), wherein the oar (44) comprises:

a bar (442);

a plate (411) formed at an upper end of the bar (442), wherein the plate (411) comprises a lower face in contact with the first slope (4121);

a hook (443) formed at a lower end of the bar (442) and operable for moving the trigger assembly to release the string (92);

a torque spring (45) pivotally connected to the box (10), wherein the torque spring (45) comprising an end movable between the dent (4131) and the second slope (4132);

a restraining element (46) comprising a tab (462) pivotable between a first position for blocking the abutment portion (4134) and a second position away from the abutment portion (4134); and a compression spring (47) for biasing the tab (462) toward the trigger assembly.

2. The string-unloading apparatus according to claim 1, wherein the restraining element (46) comprises a boss (463) fitted in an end of the compression spring (47).

3. The string-unloading apparatus according to claim 1, wherein the switch (41) comprises a first portion (412) and a second portion (413) formed on a side of the first portion (412), wherein the first slope (4121) is formed on a front face of the first portion (412), wherein the dent (4131) is made in an upper face of the second portion (413) behind the second slope (4132), wherein the cutout (4133) is made in a lower face of the second portion (413), wherein the abutment portion (4134) is formed on a front face of the second portion (413) and operable to abut against the contact portion (461).

4. The string-unloading apparatus according to claim 1, wherein the trigger assembly comprises:

a primary trigger (24) pivotally connected to the box (10);

a first spring (221) for biasing the primary trigger (24);

a locking element (25) pivotally connected to the box (10);

a second spring (222) for biasing the locking element (25) into contact with the primary trigger (24);

a string-hooking element (26) pivotally connected to the box (10), wherein the string-hooking element (26) comprises a front end for hooking the string (92); and a third spring (223) for biasing the string-hooking element (26) to bring a rear end of the string-hooking element (26) into to contact with the locking element (25).

5. The string-unloading apparatus according to claim 4, wherein the restraining element (46) comprises:

a contact portion (461) comprises a side in contact with the string-hooking element (26) and an end pivotally connected to the box (10); and a tab (462) formed on the contact portion (461) and located above the string-hooking element (26).

6. The string-unloading apparatus according to claim 4, further comprising a safety (35) for restraining the trigger assembly, wherein the bar (442) comprises an extensive portion (4421) for lifting the safety (35), and a recess (4422) for receiving a portion (352) of the safety (35).

7. The string-unloading apparatus according to claim 6, wherein the box (10) comprises two slots (321, 322) and two grooves (331, 332) in communication with the slots (321, 322) respectively, wherein the safety (35) comprises two sliding portions (352, 353) movable in the grooves (331, 332), two handles (354, 355) extending out of the box (10) from the sliding portions (352, 353) via the slots (321, 322), and a locking portion (351) formed between the sliding portions (352, 353), wherein one of the sliding portions (352) comprises two positioning dents (3522, 3524), wherein the string-unloading apparatus further comprises an elastic restraining element (34) connected to the box (10) and formed with an end inserted in a selected one of the positioning dents (3522, 3524).

8. The string-unloading apparatus according to claim 1, wherein the pulling element (43) comprising a slot (431) for receiving a pivot (1221) connected to the box (10).

* * * * *